US011731005B2

(12) United States Patent
Shinohara et al.

(10) Patent No.: US 11,731,005 B2
(45) Date of Patent: Aug. 22, 2023

(54) GOLF BALL AND METHOD FOR PRODUCING THE SAME

(71) Applicant: BRIDGESTONE SPORTS CO., LTD., Tokyo (JP)

(72) Inventors: Hirotaka Shinohara, Chichibu (JP); Takeharu Fujie, Chichibu (JP)

(73) Assignee: Bridgestone Sports Co., Ltd., Tokyo ( * ) Notice: Subject to any disclaimer, the term of this patent is extended or adjusted under 35 U.S.C. 154(b) by 0 days.

(21) Appl. No.: 17/502,232

(22) Filed: Oct. 15, 2021

(65) Prior Publication Data

US 2022/0193501 A1 Jun. 23, 2022

(30) Foreign Application Priority Data

Dec. 23, 2020 (JP) ..... 2020-213452

(51) Int. Cl.
*A63B 37/06* (2006.01)
*A63B 37/00* (2006.01)

(52) U.S. Cl.
CPC .... *A63B 37/00221* (2020.08); *A63B 37/0019* (2013.01)

(58) Field of Classification Search
CPC ..... A63B 37/0022
USPC ..... 473/378
See application file for complete search history.

(56) References Cited

U.S. PATENT DOCUMENTS

2017/0107399 A1 4/2017 Suzuki et al.
2017/0173398 A1* 6/2017 Tachibana ..... A63B 37/0045
2018/0133560 A1* 5/2018 Kimura ..... C08G 18/10
2018/0369649 A1* 12/2018 Shinohara ..... A63B 1/00

FOREIGN PATENT DOCUMENTS

JP 2017-077357 A 4/2017

* cited by examiner

*Primary Examiner* — Raeann Gorden
(74) *Attorney, Agent, or Firm* — Sughruw Mion, PLLC

(57) ABSTRACT

A method for producing a golf ball of the present invention includes the steps of: forming a first coating film on a surface of a covering having a plurality of dimples; and forming a second coating film on a surface of the first coating film. The second coating film is formed of a second coating material composition containing a polyurethane coating material and a solvent having a boiling point of 80° C. or less. An elastic recovery rate of the second coating film is 50% or more. In the golf ball of the present invention obtained by the method, an edge ratio which is a ratio of a film thickness of the second coating film in an edge portion of the dimple to a film thickness of the second coating film in a central portion of the dimple is 50% or more.

6 Claims, 1 Drawing Sheet

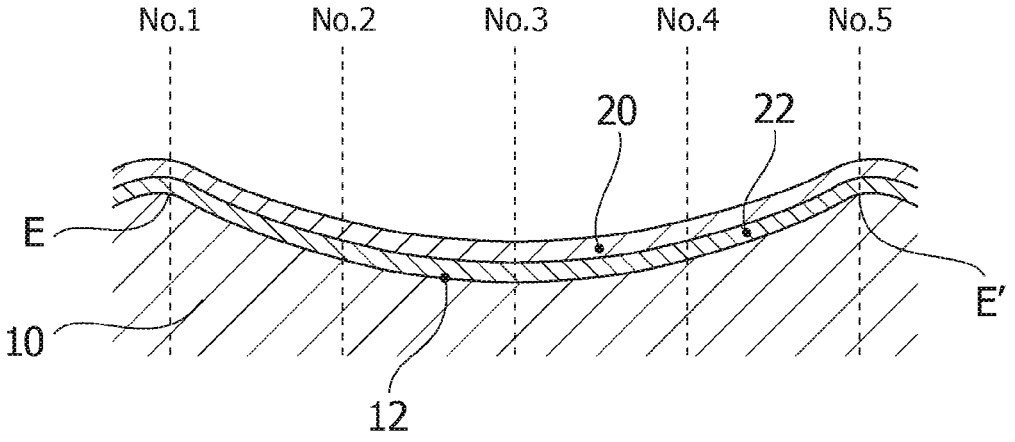
No.1
No.2
No.3
No.4
No.5
20
22
E
E′
10
12

GOLF BALL AND METHOD FOR PRODUCING THE SAME

CROSS-REFERENCE TO RELATED APPLICATION

This application claims priority from Japanese Patent Application No. 2020-213452 filed Dec. 23, 2020, which is incorporated herein by reference in its entirety.

BACKGROUND OF THE INVENTION

The present invention relates to a golf ball and to a method for producing the same.

A golf ball usually has a surface on which a coating material composition is coated in order to protect the surface of the golf ball or to satisfactorily maintain an attractive appearance. When there are defects in the surface of the golf ball, soil and grass and the like enter into the defects, even if the defects are small, which results in dirt adhering to the surface of the golf ball.

Then, in order to form a coating film having high scratch resistance on the surface of a golf ball, a coating material composition which makes it possible to form a coating film having a high elastic work recovery rate is proposed. For example, JP 2017-077357 A discloses a golf ball coating material composition primarily containing a urethane coating material made of a polyol and a polyisocyanate. The polyol to be used is an acrylic polyol, and a coating film made of the composition has an elastic work recovery rate of 70% or more.

SUMMARY OF THE INVENTION

The coating film made of the coating material composition and having a high elastic recovery rate has high scratch resistance, but it has a problem in adhering to a covering of the golf ball. The material itself of the coating film having a high elastic recovery rate is more brittle than that of a normal coating film. In particular, when the hardness of the covering is high, the coating film tends to easily peel from the covering or marks printed on the covering.

As a result of intensive research in order to achieve both scratch resistance and adhesion (or peeling resistance), increase in the thickness of the coating film was found to provide both improved scratch resistance and peeling resistance, and in particular, the above coating material composition having a high elastic recovery rate was found to make it difficult to uniformly form a thick coating film on a surface having a recessed curved surface such as a dimple. In particular, a film thickness is small in an edge portion in which a dimple is adjacent to the surface of a ball (i.e., a land portion) other than the dimple, which makes it impossible to sufficiently improve the scratch resistance and the peeling resistance, and it may disadvantageously lead also to deterioration in aerodynamic performance of the golf ball.

The present invention has been made in light of the above problems, and an object of the present invention is to provide a golf ball which includes a thick coating film capable of being uniformly formed on the surface of a dimple also including an edge portion, and is excellent in both scratch resistance and peeling resistance, and a method for producing the same.

In order to achieve the above object, according to an aspect of the present invention, a method for producing a golf ball includes the steps of: forming a first coating film on a surface of a covering having a plurality of dimples; and forming a second coating film on a surface of the first coating film, wherein the second coating film is formed of a second coating material composition containing a polyurethane coating material and a solvent having a boiling point of 80° C. or less, and an elastic recovery rate of the second coating film is 50% or more.

A film thickness of the second coating film in an edge portion of the dimple may be 10 μm or more.

The first coating film may be formed of a first coating material composition containing an acrylic resin and a urethane resin. A ratio of an amount of the acrylic resin with respect to a total amount of the acrylic resin and the urethane resin may be 50% by mass or more.

The second coating film may be formed by spray coating.

A ratio of an amount of the solvent having a boiling point of 80° C. or less with respect to a total amount of the second coating material composition may be 20% by mass or more.

According to another aspect of the present invention, a golf ball includes: a core; a covering having a plurality of dimples; and a coating film located on a surface of the covering and having a layered structure including at least a first coating film located on an inner side of the golf ball and a second coating film located on an outer side of the golf ball, wherein the second coating film contains a polyurethane coating material, an elastic recovery rate of the second coating film is 50% or more, and an edge ratio, which is a ratio of a film thickness of the second coating film in an edge portion of the dimple to a film thickness of the second coating film in a central portion of the dimple, is 50% or more.

The film thickness of the second coating film in the edge portion of the dimple may be 10 μm or more.

The first coating film may be formed of a first coating material composition containing an acrylic resin and a urethane resin. A ratio of an amount of the acrylic resin based on a total amount of the acrylic resin and the urethane resin may be 50% by mass or more.

According to the present invention, the first coating film and the second coating film containing the polyurethane coating material having an elastic recovery rate of 50% or more are formed in this order on the surface of the covering having the plurality of dimples. The coating film has the layered structure including at least two layers of an inner side coating film and an outer side coating film, and the solvent having a boiling point of 80° C. or less is blended in the second coating material composition forming the second coating film (i.e., outer side coating film), whereby the edge ratio which is the ratio of the film thickness of the outer side coating film in the edge portion of the dimple to the film thickness of the outer side coating film in the central portion of the dimple is 50% or more. This makes it possible to uniformly form a thick coating film on the surface of the dimple also including the edge portion, whereby a golf ball which is excellent in both scratch resistance and peeling resistance can be provided.

BRIEF DESCRIPTION OF THE DRAWING

FIG. 1 is a cross-sectional view schematically showing a peripheral part of a dimple of an embodiment of a golf ball according to the present invention.

DESCRIPTION OF PREFERRED EMBODIMENTS

Hereinafter, embodiments of a golf ball according to the present invention and a method for producing the same will be described.

A method for producing a golf ball of the present embodiment includes the steps of: forming a first coating film (also referred to as "inner side coating film") on a surface of a covering having a plurality of dimples; and forming a second coating film (also referred to as "outer side coating film") on a surface of the first coating film.

A first coating material composition for forming the inner side coating film preferably contains an acrylic resin and a urethane resin as a base resin, but the first coating material composition is not limited thereto. An ionomer resin and a urethane resin and the like as the base resin are blended in the covering of the golf ball, whereby the use of the acrylic resin and the urethane resin for the inner side coating film brought into contact with both the covering and the outer side coating film makes it possible to increase an affinity with the covering and adhesion to the outer side coating film.

The ratio of the acrylic resin to the urethane resin (acrylic resin:urethane resin) is, by mass, preferably 30:70 to 80:20, more preferably 50:50 to 80:20, and still more preferably 60:40 to 70:30. In particular, the increase in the ratio of the acrylic resin makes it possible to increase adhesion with the ionomer resin blended in the cover, whereby the ratio of the acrylic resin is preferably 50% by mass or more. When the ratio of the urethane resin is increased, the abrasion resistance of the entire coating film (the layered body including the inner side coating film and the outer side coating film) can be improved because the urethane resin is flexible.

As the acrylic resin, for example, a resin obtained by polymerizing one or more acrylic monomers selected from the group consisting of acrylic acid, methacrylic acid, and esters thereof, and a resin obtained by copolymerizing one or more acrylic monomers and one or more monomers other than the acrylic monomers, can be used. Among the acrylic monomers, specific examples of the acrylic esters and the methacrylic esters include alkyl (meth)acrylates such as methyl (meth)acrylate, ethyl (meth)acrylate, and butyl (meth)acrylate, benzyl (meth)acrylate, 2-hydroxyethyl (meth)acrylate, 2-hydroxypropyl (meth)acrylate, 2-hydroxybutyl (meth)acrylate, and glycidyl (meth)acrylate. Specific examples of the monomers other than the acrylic monomers include styrene. Among these, in order to improve adhesion, the acrylic esters are preferably used as the acrylic resin.

As the urethane resin, for example, a resin having a urethane bond obtained by a reaction between a polyol component and a polyisocyanate component can be used. Examples of the polyol component include a polyester, a polyether, and a polycarbonate, and examples of the polyisocyanate component include tolylene diisocyanate (TDI), diphenylmethane-diisocyanate (MDI), dicyclohexylmethane diisocyanate (hydrogenated MDI), naphthalene-1,5-diisocyanate (NDI), xylylene diisocyanate (XDI), isophorone diisocyanate (IPDI), and hexamethylene diisocyanate (HDI). Among these, as the urethane resin, the polyether-type urethane resin is preferably used in order to impart flexibility.

The first coating material composition is preferably an aqueous coating material composition. The aqueous coating material composition refers to a composition in which a resin as a base resin is dissolved or dispersed in water. The aqueous coating material composition is classified into a water-soluble coating material composition and a water-dispersible coating material composition, depending on the stabilized state of the resin in water. In the present embodiment, the water-dispersible coating material composition is preferable. The water-dispersible coating material composition is classified into a colloidal dispersion type composition (particle diameter: approximately 0.005 to 0.05 μm) and an emulsion type composition (particle diameter: approximately 0.05 to 0.5 μm), depending on the particle diameter of the resin. In the present embodiment, the water-dispersible coating material composition may be the colloidal dispersion type composition or the emulsion type composition. For example, the water-dispersible coating material composition may be provided by mixing an emulsion type acrylic resin coating material with a colloidal dispersion type urethane resin coating material.

The first coating material composition may contain a cross-linking agent in addition to the above base resin. When the acrylic resin and the urethane resin have a cross-linking reactive group, the cross-linking agent can be blended depending on the cross-linking reactive group. Examples of the cross-linking agent include a methylol compound, a polyepoxy compound, an amino resin, a polyaziridine compound, a polyoxazoline compound, a polyisocyanate compound, a sulfur compound, a hydrazine compound, a silane coupling agent, and a chelating agent, but the cross-linking agent is not limited thereto. The cross-linking agent is preferably dissolved in a solvent for the aqueous coating material composition. As the solvent for the aqueous coating material composition, water is mainly used. The blending amount of the cross-linking agent is set to be preferably, for example, 0.1 to 5 parts by mass with respect to 100 parts by mass of the base resin.

The film thickness of the inner side coating film is set to be preferably 3 μm or more, more preferably 4 μm or more, and still more preferably 5 μm or more in order to improve impact resistance. The upper limit of the film thickness is preferably 12 μm or less, and more preferably 10 μm or less in order to maintain flight improvement.

The method for forming the inner side coating film on the surface of the covering is not particularly limited, and a known method for coating a golf ball coating material on the surface of the covering can be used. For example, methods such as a spray coating method and an electrostatic coating method can be used.

A second coating material composition for forming the outer side coating film contains a polyurethane coating material and a solvent having a boiling point of 80° C. or less. The elastic recovery rate of the coating film formed of the second coating material composition is required to be 50% or more. The elastic recovery rate is calculated by the following mathematical formula based on the indentation work Welast (Nm) due to the return deformation of the material and the mechanical indentation work Wtotal (Nm).

$$\text{Elastic recovery rate (\%)} = W_{elast}/W_{total} \times 100$$

The elastic recovery rate can be measured with an ultra micro hardness tester ENT-2100 (trade name) manufactured by Elionix Co., Ltd. The elastic recovery rate is an ultra micro hardness testing method in which an indentation load is controlled on the order of micro-Newtons (μN), and an indenter depth at the time of indentation is traced to a precision of nanometers (nm). The elastic recovery rate is a parameter of a nanoindentation method evaluating the physical properties of the coating film. A conventional method could measure only the magnitude of a deformation trace (plastic deformation trace) corresponding to the maximum load. However, in the nanoindentation method, the relationship between the indentation load and the indentation depth can be obtained by performing automatic continuous measurement. Accordingly, the nanoindentation method is free from individual differences as in conventional visual measurement of deformation traces using an optical microscope, and can very precisely evaluate the physical properties of the coating film layer. The elastic recovery rate is more preferably 60% or more. The outer side coating film formed on the outermost surface of the golf ball has a high elastic force, whereby the outer side coating film has a high self-repair function and superior scratch resistance.

The following polyurethane coating material can be used as a material having such an elastic recovery rate. The polyurethane coating material is composed of a polyol as a main agent and a polyisocyanate as a curing agent. As the polyol, a polycarbonate polyol or a polyester polyol is preferably used, but the polyol is not limited thereto. Two types of polyester polyols, that is, a polyester polyol (A) and a polyester polyol (B) may also be used. It is suitable that when these two types of polyester polyols are used, the two types of polyester polyols be different in weight average molecular weight (Mw); the weight average molecular weight (Mw) of the (A) component be 20,000 to 30,000; and the weight average molecular weight (Mw) of the (B) component be 800 to 1,500. The weight average molecular weight (Mw) of the (A) component is more preferably 22,000 to 29,000, and still more preferably 23,000 to 28,000. The weight average molecular weight (Mw) of the (B) component is more preferably 900 to 1,200, and still more preferably 1,000 to 1,100.

The polyester polyol is obtained by the polycondensation between a polyol and a polybasic acid. Examples of the polyol include diols such as ethylene glycol, 1,2-propanediol, 1,3-propanediol, 1,3-butanediol, 1,4-butanediol, 1,6-hexanediol, neopentylglycol, diethylene glycol, dipropylene glycol, hexylene glycol, dimethylolheptane, polyethylene glycol, and polypropylene glycol; triols; tetraols, and polyols having an alicyclic structure. Examples of the polybasic acid include aliphatic dicarboxylic acids such as succinic acid, adipic acid, sebacic acid, azelaic acid, and dimer acid; aliphatic unsaturated dicarboxylic acids such as fumaric acid, maleic acid, itaconic acid, and citraconic acid; aromatic polybasic carboxylic acids such as phthalic acid, isophthalic acid, terephthalic acid, trimellitic acid, and pyromellitic acid; dicarboxylic acids having an alicyclic structure such as tetrahydrophthalic acid, hexahydrophthalic acid, 1,3-cyclohexanedicarboxylic acid, 1,4-cyclohexanedicarboxylic acid, and endomethylene tetrahydrophthalic acid; and tris-2-carboxyethyl isocyanurate. In particular, as the polyester polyol of the (A) component, polyester polyols having a cyclic structure introduced into the resin skeleton can be adopted. Examples of such a polyester polyol include a polyester polyol obtained by the polycondensation between a polyol having an alicyclic structure such as cyclohexane dimethanol and a polybasic acid, or a polyester polyol obtained by the polycondensation between a polyol having an alicyclic structure and diols or a triol and a polybasic acid. In addition, as the polyester polyol of the (B) component, a polyester polyol having a multibranched structure can be adopted. Examples of such a polyester polyol include polyester polyols having a branched structure such as "NIPPOLAN 800" manufactured by Tosoh Corporation.

When such a polyester polyol as described above is used, the weight average molecular weight (Mw) of the entirety of the main agent is preferably 13,000 to 23,000, and more preferably 15,000 to 22,000. The number average molecular weight (Mn) of the entirety of the main agent is preferably 1,100 to 2,000, and more preferably 1,300 to 1,850. When these average molecular weights (Mw and Mn) deviate from the above ranges, the abrasion resistance of the outer side coating film may be deteriorated. The weight average molecular weight (Mw) and the number average molecular weight (Mn) are measured values (polystyrene equivalent values) on the basis of gel permeation chromatography (hereinafter, abbreviated as GPC) measurement based on differential refractive index meter detection. Even when two types of polyester polyols are used, the Mw and Mn of the entirety of the main agent are within the above ranges.

The blending amounts of the above two types of polyester polyols (A) and (B) are not particularly limited, but the amount of the (A) component is preferably 20 to 30% by mass with respect to the total amount of the main agent inclusive of the solvent, and the blending amount of the (B) component is preferably 2 to 18% by mass with respect to the total amount of the main agent.

The polyisocyanate is not particularly limited, but it may be any of generally used aromatic, aliphatic, and alicyclic polyisocyanates and the like. Specific examples of such polyisocyanates include trilene diisocyanate, diphenylmethane diisocyanate, xylylene diisocyanate, tetramethylene diisocyanate, hexamethylene diisocyanate, lysine diisocyanate, isophorone diisocyanate, 1,4-cyclohexylene diisocyanate, naphthalene diisocyanate, trimethylhexamethylene diisocyanate, dicyclohexylmethane diisocyanate, and 1-isocyanato-3,3,5-trimethyl-4-isocyanatomethylcyclohexane.
These can each be used alone, or as mixtures of two or more thereof.

Examples of the modified product of the above hexamethylene diisocyanate include polyester-modified products and urethane-modified products of hexamethylene diisocyanate. Examples of the derivative of the above hexamethylene diisocyanate include nurates (isocyanurates), biurets and adducts of hexamethylene diisocyanate.

In the urethane coating material composed of a polyol and a polyisocyanate as the main component, the lower limit of the molar ratio (NCO group/OH group) between a hydroxyl group (OH group) belonging to the polyol and an isocyanate group (NCO group) belonging to the polyisocyanate is preferably 0.6 or more, and more preferably 0.65 or more. The upper limit of this molar ratio is preferably 1.5 or less, more preferably 1.0 or less, and still more preferably 0.9 or less. When this molar ratio is less than the above lower limit, unreacted hydroxyl groups remain, and the performance and the water resistance as the outer side coating film may be deteriorated. In addition, when this molar ratio is greater than the above upper limit, the isocyanate group is excessively present, whereby the reaction between the isocyanate group and the water content produces a urea group (fragile). Consequently, the performance of the outer side coating film may be deteriorated.

As a curing catalyst (organometallic compound) promoting the reaction between the polyol and the polyisocyanate, an amine-based catalyst or an organometallic catalyst can be used. As the organometallic compounds, compounds conventionally blended as the curing agents of a two-component curing type urethane coating material such as metal soaps of aluminum, nickel, zinc, and tin and the like can be suitably used.

As a solvent used for each of the polyols as a main agent and the polyisocyanate as a curing agent, a solvent having a boiling point of 80° C. or less is used. This makes it possible to form a coating film having a substantially uniform thickness on the surface of the golf ball including the edge portion of the dimple even when a thick coating film is formed. Examples of the solvent having a boiling point of 80° C. or less include hydrocarbon solvents such as n-hexane (68° C.), cyclohexane (80° C.), and benzene (80° C.), ester solvents such as methyl acetate (57° C.) and ethyl acetate (77° C.), and ketone solvents such as acetone (56° C.) and methyl ethyl ketone (79° C.) (boiling points are shown in parentheses). In consideration of the effects on a human body or the environment, among these, the ester solvents such as ethyl acetate and the ketone solvents such as methyl ethyl ketone (MEK) are more preferable.

Two or more thereof may be used as mixtures, and these solvents and a solvent having a boiling point greater than 80° C. may be used as mixtures. The blending amount of the solvent having a boiling point of 80° C. or less is preferably 20% by mass or more, and more preferably 40% by mass or more, with respect to the total mass of the coating material composition. The total mass of the coating material composition is the total of the total mass of the main agent including the solvent and the total mass of the curing agent including the solvent.

The film thickness of the outer side coating film in the edge portion of the dimple is preferably 10 μm or more, and more preferably 12 μm or more, from the viewpoint of scratch resistance and peeling resistance. As the film thickness of the outer side coating film increases, the scratch resistance and the peeling resistance are improved, but too great a film thickness may affect the aerodynamic characteristics of the golf ball. Therefore, the upper limit of the film thickness of the outer side coating film in the edge portion of the dimple is preferably 25 μm or less, and more preferably 20 μm or less.

As an edge ratio which is a ratio of the film thickness of the edge portion of the dimple to the film thickness of the central portion of the dimple is closer to 100%, the film thickness in the dimple is more uniform, and the edge ratio serves as an index for evaluating the uniformity of the coating film. The edge ratio is preferably 50% or more, and more preferably 70% or more. If a thick coating film is formed on the recessed surface of the dimple, the film thickness of the edge portion which is a shallow recessed portion is usually small, whereby the film thickness of the central portion which is a deep recessed portion is large. When a coating film having a high elastic recovery rate is formed, this tendency is remarkable, which makes it difficult to form a coating film having a film thickness of 10 μm or more in the edge portion of a dimple. In the present embodiment, the use of the solvent having a boiling point of 80° C. or less makes it possible to set the edge ratio to be 50% or more even when the outer side coating film having an elastic recovery rate of 50% or more is formed at a film thickness of 10 μm or more in the edge portion of the dimple.

To the second coating material composition forming the outer side coating film, a known coating material blending component may be further added as necessary. Specifically, a thickener, an ultraviolet absorber, a fluorescent whitening agent, and a pigment and the like can be blended in appropriate amounts.

The method for forming the outer side coating film is not particularly limited, and a known method for coating a golf ball coating material on the surface of the covering can be used. For example, methods such as a spray coating method and an electrostatic coating method can be used. This makes it possible to form the outer side coating film on the surface of the inner side coating film.

Both the inner side coating film and the outer side coating film may be subjected to a step of drying the coating film after the coating film is formed. Drying conditions may be the same as known conditions in which the urethane coating material is dried. In the present embodiment, for example, a drying temperature may be approximately 40° C. or more, and particularly 40° C. to 60° C., and a drying time may be 20 to 90 minutes, and particularly 40 to 50 minutes.

The method for producing a golf ball described above can provide the golf ball of the present embodiment. The golf ball of the present embodiment includes a core, a covering having a plurality of dimples, and a coating film located on the surface of the covering. The coating film has a layered structure including at least a first coating film (inner side coating film) located on an inner side of the golf ball and a second coating film (outer side coating film) located on an outer side of the golf ball. The outer side coating film contains a polyurethane coating material, and has an elastic recovery rate of 50% or more and an edge ratio of 50% or more. These characteristics of the coating film have already been described, and hereinafter, the core and the covering will be described.

The core can be formed mainly with a base material rubber. As the base material rubber, a wide variety of rubbers (thermosetting elastomers) can be used. For example, the following rubbers can be used: a polybutadiene rubber (BR), a styrene-butadiene rubber (SBR), a natural rubber (NR), a polyisoprene rubber (IR), a polyurethane rubber (PU), a butyl rubber (IIR), a vinyl polybutadiene rubber (VBR), an ethylene-propylene rubber (EPDM), a nitrile rubber (NBR), and a silicone rubber; however, the base material rubber is not limited thereto. As the polybutadiene rubber (BR), for example, 1,2-polybutadiene and cis-1,4-polybutadiene and the like can be used.

To the core, in addition to the base material rubber as the main component, for example, a co-cross-linking material, a cross-linking agent, a filler, an antiaging agent, an isomerization agent, a peptizer, sulfur, and an organosulfur compound can be optionally added. As the main component, in place of the base material rubber, a thermoplastic elastomer, an ionomer resin, or a mixture of these can also be used.

The core has a substantially spherical shape. The upper limit of the outer diameter of the core is preferably approximately 42 mm or less, more preferably approximately 41 mm or less, and still more preferably approximately 40 mm or less. The lower limit of the outer diameter of the core is preferably approximately 5 mm or more, more preferably approximately 15 mm or more, and most preferably approximately 25 mm or more. The core may be solid or hollow. The core may have a single layer, or may be a core composed of a plurality of layers such as the center core and a layer surrounding the core.

As the method for molding the core, it is possible to adopt a known method for molding a core of a golf ball. For example, a core can be obtained by kneading a material containing a base material rubber with a kneading machine, and by pressure vulcanization molding of the resulting kneaded product with a round mold, but the method is not limited thereto. As a method for molding a core having a plurality of layers, it is possible to adopt a known method for molding a solid core having a multilayer structure. For example, a multilayer core can be obtained as follows: a center core is obtained by kneading materials with a kneading machine, and by pressure vulcanization molding of the resulting kneaded product with a round mold; then materials for a surrounding layer are kneaded with a kneading machine, and the resulting kneaded product is molded into a sheet shape to obtain a sheet for the surrounding layer; the center core is covered with the sheet to prepare a covered center core; and the covered center core is then subjected to pressure vulcanization molding with the round mold to prepare the multilayer core.

The covering can be formed by using thermoplastic polyurethane, an ionomer resin, or a mixture thereof, but the materials for the covering are not limited thereto. In particular, in view of adhesion to the inner side coating film, it is preferable to use the ionomer resin.

The structure of the thermoplastic polyurethane material is composed of a soft segment composed of a polymer polyol (polymeric glycol) and a chain extender and polyisocyanate constituting a hard segment. Here, the polymer polyol to be a raw material is not particularly limited, but it is preferably, in the present invention, a polyester-based polyol and a polyether-based polyol. Specific examples of the polyester-based polyol include adipate-based polyols such as polyethylene adipate glycol, polypropylene adipate glycol, polybutadiene adipate glycol, and polyhexamethylene adipate glycol; and lactone-based polyols such as polycaprolactone polyol. Examples of the polyether polyol include poly(ethylene glycol), poly(propylene glycol), and poly(tetramethylene glycol).

The chain extender is not particularly limited, but in the present invention, it is possible to use, as the chain extender, a low molecular weight compound having two or more active hydrogen atoms which can react with isocyanate groups in the molecule thereof, and having a molecular weight of 2,000 or less. In particular, an aliphatic diol having 2 to 12 carbon atoms is preferable. Specific examples of the chain extender include 1,4-butylene glycol, 1,2-ethylene glycol, 1,3-butanediol, 1,6-hexanediol, and 2,2-dimethyl-1,3-propanediol. In particular, 1,4-butylene glycol is preferable.

The polyisocyanate compound is not particularly limited, but in the present invention, for example, it is possible to use one or two or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene 1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate, and dimeric acid diisocyanate. However, some isocyanate species make it difficult to control the cross-linking reaction during injection molding. Accordingly, in the present invention, 4,4'-diphenylmethane diisocyanate which is an aromatic diisocyanate is preferable from the viewpoint of the balance between stability during production and developed physical properties.

As the ionomer resin, it is possible to use a resin containing, as a base resin, the following (a) component and/or the following (b) component, but the ionomer resin is not limited thereto. To the base resin, the following (c) component can be optionally added. The (a) component is a ternary random olefin-unsaturated carboxylic acid-unsaturated carboxylic acid ester copolymer and/or a metal salt thereof; the (b) component is an olefin-unsaturated carboxylic acid binary random copolymer and/or a metal salt thereof; and the (c) component is a thermoplastic block copolymer having a crystalline polyolefin block, and polyethylene/butylene random copolymer.

In the resin for the covering, in addition to the main component of the above thermoplastic polyurethane or ionomer resin, thermoplastic resins or elastomers other than the thermoplastic polyurethane can be blended. Specifically, it is possible to use one or two or more selected from a polyester elastomer, a polyamide elastomer, an ionomer resin, a styrene block elastomer, a hydrogenated styrene butadiene rubber, a styrene-ethylene/butylene-ethylene block copolymer or a modified product thereof, an ethylene-ethylene/butylene-ethylene block copolymer or a modified product thereof, a styrene-ethylene/butylene-styrene block copolymer or a modified product thereof, an ABS resin, polyacetal, polyethylene and a nylon resin. In particular, for example, because resilience and abrasion resistance are improved due to the reaction with the isocyanate group while productivity is satisfactorily maintained, it is suitable to adopt a polyester elastomer, a polyamide elastomer, and polyacetal. When the above components are blended, the blending amounts thereof are appropriately selected, without being particularly limited, according to the regulation of the hardness, the improvement of the resilience, the improvement of the fluidity, and the improvement of the adhesion and the like of the covering material. However, the blending amounts of the above components can preferably be set to be 5 parts by mass or more with respect to 100 parts by mass of the thermoplastic polyurethane component. The upper limit of the blending amount is also not particularly limited, but can be set to be preferably 100 parts by mass or less, more preferably 75 parts by mass or less, and still more preferably 50 parts by mass or less, with respect to 100 parts by mass of the thermoplastic polyurethane component. In addition, polyisocyanate compounds, fatty acids or derivatives thereof, basic inorganic metal compounds, and fillers and the like can be added.

For a method for forming the covering, known golf ball covering molding methods can be adopted. The covering forming method is not particularly limited, but examples of the covering forming method include a method in which a core is disposed in a mold; and a resin composition for a covering is molded by injection molding, whereby the covering can be formed so that it covers the core. The mold for molding the covering has a plurality of protrusions for forming dimples on the surface of the covering. The size, shape, and number and the like of the dimples formed on the surface of the covering can be appropriately designed according to the aerodynamic properties desired for the golf ball.

The lower limit of the thickness of the covering is preferably 0.2 mm or more, and more preferably 0.4 mm or more, and the upper limit thereof is preferably 4 mm or less, more preferably 3 mm or less, and still more preferably 2 mm or less, but the thickness of the covering is not limited thereto.

The upper limit of the material hardness of the covering in terms of Shore D is preferably approximately 60 or less, more preferably approximately 55 or less, and still more preferably approximately 50 or less, but the material hardness of the covering is not limited thereto. The lower limit of the material hardness of the covering in terms of Shore D is preferably approximately 35 or more, and more preferably approximately 40 or more. The resin material of the covering is formed into a sheet shape having a thickness of 2 mm, and the sheet is left for 2 weeks or more. Then, the material hardness of the covering as Shore D hardness is measured in conformity with the ASTM D2240-95 standard.

EXAMPLES

Hereinafter, Examples of the present invention and Comparative Examples will be described.

When golf balls of Examples and Comparative Examples were produced, coating films of the golf balls were produced by using coating material blending shown in Table 1. The blending in Table 1 was represented in terms of parts by mass. The film thickness of the coating film was measured, and the produced golf balls were subjected to sand abrasion tests and sand/water abrasion tests to evaluate peeling resistance and scratch resistance.

In the coating material blending of an inner side coating film in Table 1, as an acrylic resin which was a base resin, an emulsion-based thermoplastic acrylic resin NeoCryl A-6092 (trade name) manufactured by DSM Coating Resins was used. An aqueous urethane dispersion NeoRez R-967 (trade name) manufactured by DSM Coating Resins was used as a urethane resin which was a base resin. In addition to these base resins, a cross-linking agent was blended in the inner side coating film. As the cross-linking agent, an aziridine-based cross-linking agent NeoCryl CX-100 manufactured by DSM Coating Resins was used. A coating material containing the base resins, the cross-linking agent, and water at 100:1.3:3 was applied to the surface of a covering in which dimples were formed, by spray coating, to form the inner side coating film. In Comparative Example 3, the surface of a covering was subjected to a plasma treatment without an inner side coating film being formed. That is, in Comparative Example 3, a coating film was composed of only one outer side coating film.

In the coating material blending of an outer side coating film in Table 1, as a polyol (solid content) in a main agent, a polyester polyol having a weight average molecular weight (Mw) of 28,000 was used. This was synthesized by the following method. Into a reactor equipped with a reflux cooling tube, a dropping funnel, a gas introduction tube, and a thermometer, 140 parts by mass of trimethylolpropane, 95 parts by mass of ethylene glycol, 157 parts by mass of adipic acid, and 58 parts by mass of 1,4-cyclohexanedimethanol were charged. The resulting mixture was increased in temperature to 200 to 240° C. while stirring, and the mixture was heated (was allowed to react) for 5 hours. Then, a polyester polyol having an acid value of 4, a hydroxyl value of 170, and a weight average molecular weight (Mw) of 28,000 was obtained.

For hexamethylene diisocyanate (HDI) as an isocyanate (solid content) of a curing agent, nurate (isocyanurate) of hexamethylene diisocyanate (HMDI) of Duranate TPA-100 (trade name) (NCO content: 23.1%, non-volatile content: 100%) manufactured by Asahi Kasei Corporation was used.

Ethyl acetate (boiling point: 77° C.) and butyl acetate (boiling point: 126° C.) were used as a solvent for the main agent and curing agent of the outer side coating film. A coating material obtained by mixing the main agent with the curing agent was applied onto the inner side coating film by spray coating to form the outer side coating film. The elastic recovery rate of the outer side coating film in Table 1 is measured by the following measuring method.

Method for Measuring Elastic Recovery Rate

A coating film sheet having a thickness of 50 μm was formed in each blending, and the elastic recovery rate of the coating film sheet was measured. An ultra micro hardness tester "ENT-2100" manufactured by Erionix Inc. was used as a measurement apparatus, and measurement conditions were as follows.

Indenter: Berkovich indenter (material: diamond; angle α: 65.03°)

Load F: 0.2 mN

Loading time: 10 seconds

Holding time: 1 second

Unloading time: 10 seconds

The elastic recovery rate was calculated according to the following mathematical formula based on the indentation work Welast (Nm) due to the return deformation of the coating film and on the mechanical indentation work Wtotal (Nm).

$$\text{Elastic recovery rate (\%)} = \text{Welast}/\text{Wtotal} \times 100$$

In all of the golf balls, the covering was composed of 50 parts by mass of Himilan 1605 (trade name) and 50 parts by mass of Himilan AM7329, each being an ionomer resin of an ethylene-methacrylic acid copolymer manufactured by Du Pont-Mitsui Polychemicals Co., Ltd. The material hardness of the covering was 63 in terms of Shore D.

In all of the golf balls, the intermediate layer was composed of 35 parts by mass of Himilan 1706 (trade name), 15 parts by mass of Himilan 1557 (trade name) and 50 parts by mass of Himilan 1605 (trade name), each being an ionomer resin of an ethylene-methacrylic acid copolymer manufactured by Du Pont-Mitsui Polychemicals Co., Ltd., and 1.1 parts by mass of trimethylol propane.

In all of the golf balls, the core was composed of 20 parts by mass of a polybutadiene BR51 (trade name) manufactured by JSR Corporation and 80 parts by mass of a polybutadiene BR-01 (trade name) manufactured by JSR Corporation as a base material rubber; 28.5 parts by mass of zinc acrylate (manufactured by Wako Pure Chemical Industries, Ltd.); 1.0 part by mass of dicumyl peroxide (PERCUMYL D (trade name) manufactured by NOF Corporation) as an organic peroxide; 0.1 part by mass of 2,2-methylenebis(4-methyl-6-butylphenol) (Nocrac NS-6 (trade name)) manufactured by Ouchi Shinko Chemical Industrial Co., Ltd.) as an antiaging agent; 33.0 parts by mass of barium sulfate (Precipitated Barium Sulfate #100 (trade name) manufactured by Sakai Chemical Industry Co., Ltd.); 4.0 parts by mass of zinc oxide (Third Grade Zinc Oxide (trade name) manufactured by Sakai Chemical Industry Co., Ltd.); and 0.5 parts by mass of a pentachlorothiophenol zinc salt (manufactured by Wako Pure Chemical Industries, Ltd.) as an organosulfur compound.

Method for Measuring Film Thickness

The film thickness of each of the inner side coating film and the outer side coating film in each of the central portion and the edge portion of the dimple in Table 1 was calculated by the following measuring method. First, in the cross section of a dimple 12 of a covering 10 shown in FIG. 1, one to five lines were perpendicularly drawn at regular intervals, and taken as No. 1, No. 2, No. 3, No. 4, and No. 5 in order from an edge portion E of the dimple to an edge portion E opposed thereto. The film thickness of each of an inner side coating film 22 and an outer side coating film 20 in each line was measured. The golf ball was cut, and the film thickness of the cross section at each position was measured by using a microscope. In each of the inner side coating film and the outer side coating film, the average value of the film thicknesses in No. 1 and No. 5 was taken as the film thickness of the edge portion of the dimple, and the average value of the film thicknesses in No. 2, No. 3, and No. 4 was taken as the film thickness of the central portion of the dimple.

An edge ratio which was a ratio of the film thickness of the edge portion to the film thickness of the central portion of the dimple was calculated by the following mathematical formula.

$$\text{Edge ratio [\%]} = \frac{\text{Film thickness of edge portion}}{\text{Film thickness of central portion}} \times 100$$

Sand Abrasion Test

The sand abrasion tests in Table 1 were performed by the following method. A pot mill having an outside diameter of 210 mm was charged with approximately 4 kg of sand having a size of approximately 5 mm, and 15 golf balls were placed in the pot mill. The golf balls were agitated in the pot mill at a speed of approximately 50 to 60 rpm for 120 minutes. Then, the golf balls were removed from the pot mill, and the appearance of each of the golf balls was observed according to the following criteria to evaluate two characteristics of peeling resistance and scratch resistance.

Regarding the peeling resistance, each of the golf balls was irradiated with UV light to observe a peeling condition caused by abrasion in the surface of the golf ball. The peeling condition was scored by determination criterion for a case of no peeling as 5 points, a case of a small observed amount of peeling as 3 points, and a case of a conspicuous, large amount of peeling as 1 point. The average value of the evaluation results of five golf balls was taken as the peeling resistance. A case of 2 points or less was evaluated as bad; a case of more than 2 points to 2.5 points was evaluated as poor; a case of more than 2.5 points to 4 points was evaluated as good; and a case of more than 4 points was evaluated as very good.

Regarding the scratch resistance, the surface of each of the golf balls was enlarged by a magnifying glass to observe the level of fine flaws in the coating film. The level of the fine flaws of the coating film was evaluated by determination criteria for a case of no conspicuous flaws as 5 points, a case of small flaws observed as 3 points, and a case of large flaws and decline of gloss and the like were conspicuous as 1 point. The average value of the evaluation results of five golf balls was taken as the scratch resistance. A case of 2 points or less was evaluated as bad; a case of more than 2 points to 2.5 points was evaluated as poor; a case of more than 2.5 points to 4 points was evaluated as good; and a case of more than 4 points was evaluated as very good.

Sand/Water Abrasion Test

The sand/water abrasion tests in Table 1 were performed by the following method. A pot mill having an outside diameter of 210 mm was charged with approximately 4 kg of sand having a size of approximately 5 mm and with water, and 15 golf balls were placed in the pot mill. The golf balls were agitated in the pot mill at a speed of approximately 50 to 60 rpm for 120 minutes. Then, the golf balls were removed from the pot mill, and irradiated with UV light to observe peeling conditions caused by abrasion in the surface of each of the golf balls. The peeling condition was evaluated by determination criterion for a case of no peeling as 5 points, a case of small observed amounts of peeling as 3 points, and a case of conspicuous large amounts of peeling as 1 point. The average value of the evaluation results of five golf balls was taken as the peeling resistance. A case of 2 points or less was evaluated as bad; a case of more than 2 points to 2.5 points was evaluated as poor; a case of more than 2.5 points to 4 points was evaluated as good; and a case of more than 4 points was evaluated as very good.

TABLE 1

| | | | | Examples | | | | | Comparative Examples | | |
|---|---|---|---|---|---|---|---|---|---|---|---|
| | | | | 1 | 2 | 3 | 4 | 5 | 1 | 2 | 3 |
| Coating material blending | Inner side coating film | Base resin | Acrylic resin | 30 | 50 | 70 | 70 | 70 | 70 | 70 | — |
| | | | Urethane resin | 70 | 50 | 30 | 30 | 30 | 30 | 30 | |
| | Outer side coating film | Main agent | Polyol | 30 | 30 | 30 | 30 | 30 | 30 | 30 | 30 |
| | | | Ethyl acetate | 70 | 70 | 70 | 70 | 35 | 0 | 70 | 70 |
| | | | Butyl acetate | 0 | 0 | 0 | 0 | 35 | 70 | 0 | 0 |
| | | | Boiling point of solvent [° C.] | 77 | 77 | 77 | 77 | 77/126 | 126 | 77 | 77 |
| | | Curing agent | HDI | 21 | 21 | 21 | 21 | 21 | 21 | 0 | 21 |
| | | | HDI · TDI | 0 | 0 | 0 | 0 | 0 | 0 | 21 | 0 |
| | | | Butyl acetate | 29 | 29 | 29 | 29 | 29 | 29 | 29 | 29 |
| | | | Boiling point of solvent [° C.] | 126 | 126 | 126 | 126 | 126 | 126 | 126 | 126 |
| | | Amount of solvent having boiling point of 80° C. or lower [%] | | 47 | 47 | 47 | 47 | 23 | 0 | 47 | 47 |
| | | Elastic recovery rate [%] | | 60 | 60 | 60 | 60 | 60 | 60 | 20 | 60 |
| Film thickness | Inner side coating film [m] | Central portion | | 8.0 | 8.0 | 8.0 | 8.0 | 8.0 | 4.7 | 9.2 | |
| | | Edge portion | | 5.0 | 5.5 | 6.0 | 6.0 | 6.0 | 2.7 | 7.1 | |
| | Outer side coating film [m] | Central portion | | 14.0 | 14.0 | 14.0 | 19.0 | 14.0 | 14.0 | 14.0 | 14.0 |
| | | Edge portion | | 10.0 | 10.0 | 10.0 | 15.0 | 8.0 | 6.0 | 9.0 | 10.0 |
| | | Edge ratio [%] | | 71 | 71 | 71 | 79 | 57 | 43 | 64 | 71 |
| | Total [m] | Central portion | | 22.0 | 22.0 | 22.0 | 27.0 | 22.0 | 18.7 | 23.2 | 14.0 |
| | | Edge portion | | 15.0 | 15.5 | 16.0 | 21.0 | 14.0 | 8.7 | 16.1 | 10.0 |
| Test results | Sand abrasion | Peeling resistance | | 4.3 | 4.4 | 4.5 | 5.0 | 4.0 | 3.0 | 5.0 | 3.0 |
| | | Evaluation | | Very good | Very good | Very good | Very good | Good | Good | Very good | Good |
| | | Scratch resistance | | 3.5 | 3.5 | 3.5 | 4.0 | 3.0 | 2.0 | 1.8 | 2.5 |
| | | Evaluation | | Good | Good | Good | Good | Good | Bad | Bad | Poor |
| | Sand/water abrasion | Peeling resistance | | 3.5 | 3.5 | 4.0 | 4.5 | 3.0 | 2.5 | 4.0 | 3.0 |
| | | Evaluation | | Good | Good | Good | Very good | Good | Poor | Good | Good |

As shown in Table 1, in the golf balls of Examples 1 to 4, the solvent having a boiling point of 80° C. or less was used for the formulation of the outer side coating film, whereby the outer side coating film having a film thickness of 10 mm or more could be formed at a high edge ratio of 70% or more in the edge portion of the dimple. The outer side coating film having an elastic recovery rate of 60% and having such a film thickness could be formed, whereby the golf balls of Examples 1 to 4 were excellent in scratch resistance, and were also excellent in peeling resistance in both the sand abrasion test and the sand/water abrasion test. In particular, in the golf ball of Example 4, a markedly thick outer side coating film of 15 mm could be formed at a high edge ratio of 80% or more in the edge portion of the dimple. The golf ball of Example 4 was also markedly superior in scratch resistance and peeling resistance.

In the golf ball of Example 5, a solvent having a boiling point of 80° C. or less and a solvent having a boiling point of higher than 80° C. were used in combination for the formulation of the outer side coating film, but the content of the solvent having a boiling point of 80° C. or less was 20% or more, whereby the outer side coating film having a film thickness of 8 mm could be formed at an edge ratio of 57% in the edge portion of the dimple. Therefore, good results could be obtained for both the scratch resistance and the peeling resistance.

In addition, in the golf ball of Comparative Example 1, the boiling point of the solvent used for the formulation of the outer side coating film was higher than 80° C., whereby an edge ratio was as low as 43%, and the film thickness of the outer side coating film in the edge portion of the dimple was as small as 6 mm. Accordingly, the golf ball of Comparative Example 1 was significantly poor in scratch resistance although it had a high elastic recovery rate of 60%, and was also poor in peeling resistance in the sand/water abrasion test.

In the golf ball of Comparative Example 2, the boiling point of the solvent used for the formulation of the outer side coating film was 80° C. or less, whereby the outer side coating film having a film thickness of 9 mm could be formed at a high edge ratio of 64% in the edge portion of the dimple, which made it possible to provide excellent peeling resistance in both the sand abrasion test and the sand/water abrasion test. However, in the coating material blending of the outer side coating film, the elastic recovery rate of the outer side coating film was as low as 20%, which accordingly caused significantly poor scratch resistance.

Furthermore, in the golf ball of Comparative Example 3, the boiling point of the solvent used for the formulation of the outer side coating film was 80° C. or less, whereby the outer side coating film having a film thickness of 10 mm could be formed at a high edge ratio of approximately 70% in the edge portion of the dimple, but only the outer side coating film was formed as the coating film without the inner side coating film being formed on the surface of the cover. Accordingly, the golf ball of Comparative Example 3 was poor in scratch resistance regardless of a high elastic recovery rate of 60%, and peeling resistance in the sand abrasion test and the sand/water abrasion test was also not found to be improved as that in Examples 1 to 4.

What is claimed is:

1. A method for producing a golf ball, comprising the steps of:

forming a first coating film on a surface of a covering having a plurality of dimples; and forming a second coating film on a surface of the first coating film, wherein the second coating film is formed of a second coating material composition containing a polyurethane coating material and a solvent having a boiling point of 80° C. or less; and an elastic recovery rate of the second coating film is 50% or more, and wherein the first coating film is formed of a first coating material composition containing an acrylic resin and a urethane resin; and a ratio of an amount of the acrylic resin with respect to a total amount of the acrylic resin and the urethane resin is 50% by mass or more.

2. The method for producing a golf ball according to claim 1, wherein a film thickness of the second coating film in an edge portion of the dimple is 10 μm or more.

3. The method for producing a golf ball according to claim 1, wherein the second coating film is formed by spray coating.

4. The method for producing a golf ball according to claim 1, wherein a ratio of an amount of the solvent having a boiling point of 80° C. or less with respect to a total amount of the second coating material composition is 20% by mass or more.

5. A golf ball comprising:

a core;

a covering having a plurality of dimples; and a coating film located on a surface of the covering and having a layered structure comprising a first coating film located on an inner side of the golf ball and a second coating film located on an outer side of the golf ball, wherein the second coating film comprises a polyurethane coating material, an elastic recovery rate of the second coating film is 50% or more, and an edge ratio, which is a ratio of a film thickness of the second coating film in an edge portion of the dimple with respect to a film thickness of the second coating film in a central portion of the dimple, is 50% or more, and wherein the first coating film comprises an acrylic resin and a urethane resin, and a ratio of an amount of the acrylic resin with respect to a total amount of the acrylic resin and the urethane resin is 50% by mass or more.

6. The golf ball according to claim 5, wherein the film thickness of the second coating film in the edge portion of the dimple is 10 μm or more.

* * * * *